US006060990A

United States Patent [19]

Flegel

[11] Patent Number: 6,060,990

[45] Date of Patent: May 9, 2000

[54] MOUNTING ARRANGEMENT FOR A HEAT ALARM

[75] Inventor: Jeffrey D. Flegel, Racine, Wis.

[73] Assignee: Reliance Controls Corporation, Racine, Wis.

[21] Appl. No.: 09/392,883

[22] Filed: Sep. 9, 1999

[51] Int. Cl.[7] ..... G08B 17/00

[52] U.S. Cl. ..... 340/584; 337/376; 337/333; 337/359; 374/141; 374/152

[58] Field of Search ..... 340/584, 578, 340/594, 693, 691.8; 337/376, 333, 359; 374/141, 152

[56] References Cited

U.S. PATENT DOCUMENTS

| | | | |
|---|---|---|---|
| 3,878,539 | 4/1975 | Gooding | 340/274 |
| 4,660,027 | 4/1987 | Davis | 340/636 |
| 4,698,621 | 10/1987 | Masot | 340/639 |
| 4,706,073 | 11/1987 | Vila Masot | 340/639 |
| 4,864,283 | 9/1989 | Seto | 340/584 |
| 4,962,373 | 10/1990 | Sirois | 340/693 |
| 5,072,211 | 12/1991 | Clement | 340/521 |
| 5,461,367 | 10/1995 | Altavela et al. | 340/584 |
| 5,847,653 | 12/1998 | Flegel | 340/584 |
| 5,880,667 | 10/1997 | Altavela et al. | 337/376 |
| 5,929,762 | 7/1999 | Missimer, Jr. | 340/584 |

*Primary Examiner*—Jeffery A. Hofsass
*Assistant Examiner*—Hung Nguyen
*Attorney, Agent, or Firm*—Andrus, Sceales, Starke & Sawall

[57] ABSTRACT

A heat alarm for an electric panel cabinet that mounts a heat sensor in contact with a face surface of the electric panel cabinet to monitor the temperature of the cabinet and sound an alarm if the temperature of the cabinet exceeds an upper temperature limit. The heat alarm includes a mounting arrangement that permits the heat alarm to be mounted to a face surface of the electric panel cabinet. A sensor mounting arrangement within the heat alarm enclosure provides a bias force on the heat sensor to bias the heat sensor into contact with the face surface of the electric panel cabinet.

20 Claims, 2 Drawing Sheets

FIG. 4
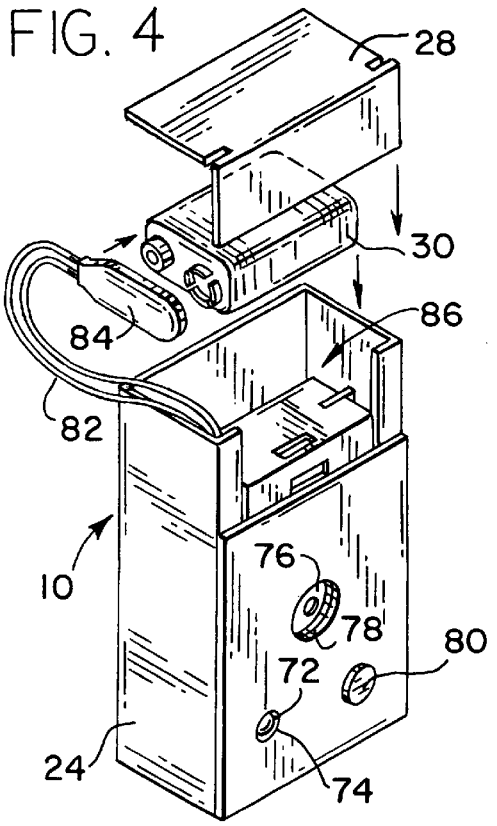
FIG. 5
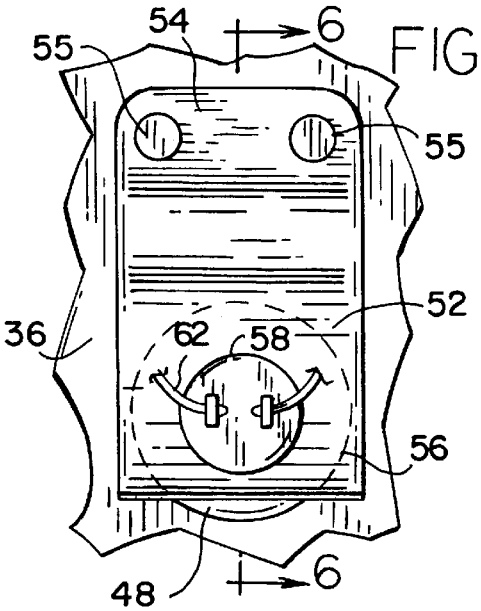
FIG. 6
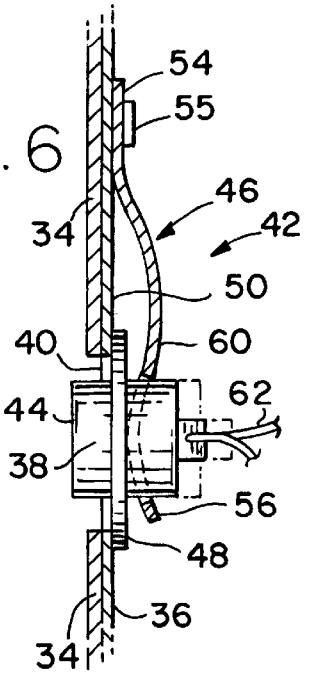
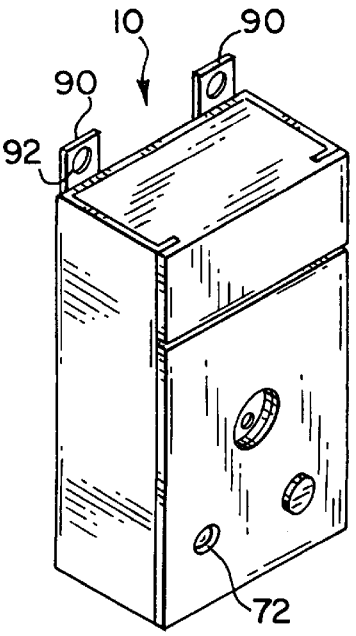
FIG. 7
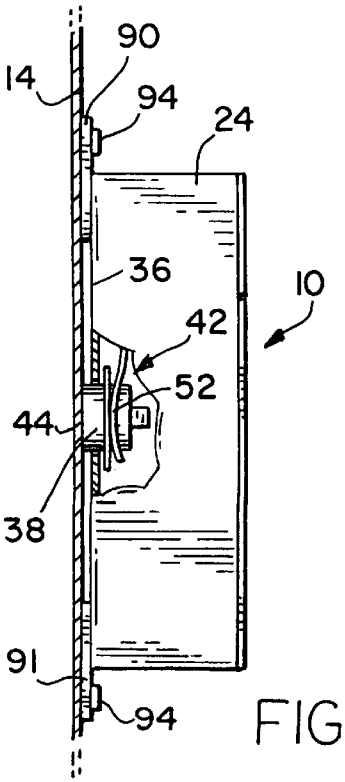
FIG. 8

MOUNTING ARRANGEMENT FOR A HEAT ALARM

BACKGROUND OF THE INVENTION

The present invention relates to a mounting arrangement for a heat alarm. More specifically, the present invention relates to a heat alarm that includes a magnetic mounting arrangement that allows the heat alarm to be mounted to a face surface of an electric panel cabinet and non-invasively monitor the temperature within the cabinet.

Electric panel cabinets typically house the main electric service panels or subpanels for the electric supply to a building. Electric panel cabinets typically contain many components that may overheat and start fires, such as feeder conductors, branch circuit conductors, circuit breakers, fuses, and bus bars. The overheating of one of these electrical components within the electric panel cabinet can be caused by many types of malfunctions, such as loose or corroded connections, power overloads, or other malfunctions in the components themselves. When one of the electric components malfunctions, the large amount of voltage and current flowing through the components causes heat buildup within the cabinet and ultimately can ignite a fire within the cabinet, which then creates a fire hazard.

Although smoke alarms are required to be in every residential or commercial building by the majority of local building codes, these smoke alarms often do not provide adequate protection against fires started in the electric panel cabinets. Specifically, smoke alarms are often not located near the electric panel cabinet, since the electric panel cabinet is typically located in a remote area of the building away from the normally occupied areas. Even if a smoke alarm is located near the electric panel cabinet, the smoke alarm typically reacts only after a fire has started and a sufficient amount of smoke has been produced. In an electric panel cabinet, an overheat condition may exist for hours or even days before smoke is present to trip a smoke alarm. Thus, an opportunity exists to activate an alarm before a fire starts by sensing an overheat condition occurring within the electric panel cabinet. Additionally, since many smoke alarms are connected to the building's electrical system, a fire started in the electric panel cabinet can cause a loss of electric power, which then disables the smoke alarm.

Altavela U.S. Pat. No. 5,461,367 teaches an electric panel heat alarm that responds to an overheat condition within an electric panel cabinet. The alarm disclosed in the '367 patent positions a heat sensor within the enclosed area defined by the cabinet and uses a battery power supply to activate an audible alarm when the temperature within the electric panel cabinet exceeds an upper temperature limit. While the alarm disclosed in the '367 patent operates to indicate an overheat condition in the electric panel cabinet, the alarm of the '367 patent suffers from several drawbacks. Specifically, the alarm of the '367 patent includes a metallic conduit nipple extending between the alarm enclosure and the electric panel cabinet through a knockout opening contained in the top wall of the electric panel cabinet. Thus, in order to use the alarm disclosed in the '367 patent, the electric panel cabinet must either include a knockout opening or have an opening formed in its top wall. Additionally, if the electric panel cabinet is positioned in a building in a manner that makes the top wall of the electric panel cabinet inaccessible, the alarm disclosed in the '367 patent cannot be used in the manner disclosed. Thus, the mounting arrangement of the alarm disclosed in the '367 patent provides limited mounting options when the electric panel cabinet is positioned in a tightly confined area.

Further, the alarm of the '367 patent positions the heat sensor within the interior of the cabinet. Accordingly, the heat sensor can only detect an overheat condition when heat is conducted to the location of the heat sensor by the static air within the interior of the cabinet. It has been found that the static air within the interior of the cabinet is a poor conductor of heat. This can result in a significant time lapse between initiation of an overheat condition and detection of the overheat condition by the heat sensor, especially when the heat sensor is in a remote location within the cabinet from the heat source.

It is therefore an object of the present invention to provide a heat alarm that responds to an overheat condition in an electric panel cabinet by activating an audible alarm. It is a further object of the invention to provide a heat alarm having a mounting arrangement that allows the heat alarm to be positioned in multiple locations on the electric panel cabinet, and which overcome the drawbacks involved in relying upon heat conduction by the static air condition within the cabinet interior. Yet another object of the invention is to provide a heat alarm in which the mounting arrangement provides a magnetic attachment to the electric panel cabinet, thereby eliminating the need for a knockout opening in the electric panel cabinet. It is a further object of the invention to provide a sensor mounting arrangement that provides the required bias force to hold a heat sensor in contact with the electric panel cabinet when the heat alarm is mounted to the electric panel cabinet.

Various other features, objects and advantages of the invention will be made apparent from the following description taken together with the drawings.

SUMMARY OF THE INVENTION

The present invention is a heat alarm that responds to an overheat condition within an enclosed area defined by an electric panel cabinet. The present invention includes a magnetic mounting arrangement that attaches the heat alarm enclosure to the electric panel cabinet.

The heat alarm of the invention includes an enclosure that contains the operating components for the heat alarm. A magnetic mounting arrangement is fixed to an outer wall of the enclosure. A heat sensor extends through a sensor opening formed in the outer wall of the enclosure including the mounting arrangement. A sensor mounting arrangement is positioned in the heat alarm enclosure to exert a bias force on the heat sensor to force to heat sensor into an extended position. In its extended position, the heat sensor extends from the enclosure a distance greater than the thickness of the magnetic mounting arrangement.

When the heat alarm is magnetically attached to a face surface of the electric panel cabinet, the magnetic attraction between the mounting arrangement and the electric panel cabinet forces the heat sensor inward against the bias force provided by the sensor mounting arrangement. The sensor mounting arrangement continues to apply the bias force, such that the heat sensor is pressed into contact with the face surface of the electric panel cabinet. In this manner, the heat sensor can monitor the temperature of the electric panel cabinet.

The sensor mounting arrangement includes a spring arm having a first end fixed to the heat alarm enclosure. The second end of the spring arm interacts with a flange attached to the heat sensor such that the spring arm exerts the outward bias force on the flange. The flange is sized larger than the sensor opening such that the flange limits the outward movement of the heat sensor to define the extended position for the heat sensor. When the heat alarm is attached to the electric panel cabinet, the heat sensor is forced inward against the bias force generated by the spring arm, such that the bias force provided by the spring arm forces the heat sensor into contact with the electric panel cabinet.

Other features and advantages of the invention may be apparent to those skilled in the art upon inspecting the following drawing and description thereof.

BRIEF DESCRIPTION OF THE DRAWINGS

The drawings illustrate the best mode presently contemplated of carrying out the invention.

In the drawings:

FIG. 4 is an exploded isometric view of the heat alarm of the present invention;

FIG. 5 is a partial sectional view of the sensor mounting arrangement taken along line 5—5 of FIG. 2;

FIG. 6 is a partial sectional view of the sensor mounting arrangement taken along line 6—6 of FIG. 5;

FIG. 7 is an isometric view showing the mounting arrangement of a second embodiment of the heat alarm of the present invention; and FIG. 8 is a side elevation view, with a portion broken away, showing the heat alarm and mounting arrangement of FIG. 7.

DETAILED DESCRIPTION OF THE DRAWINGS

Figure 1:
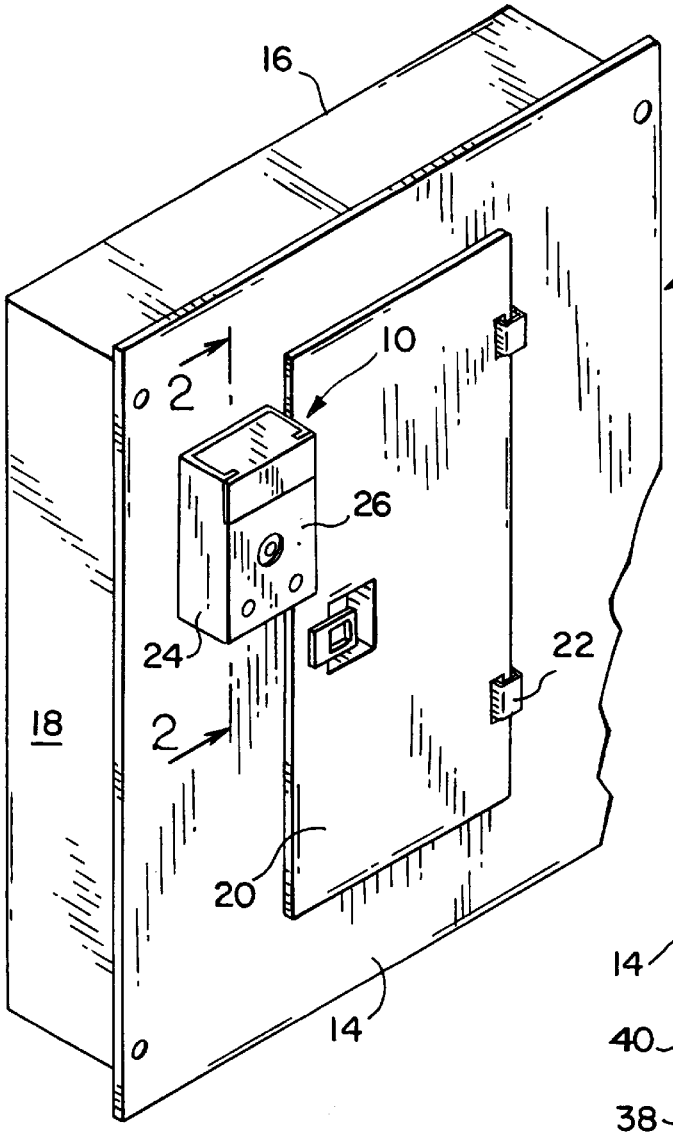
FIG. 1 is a general isometric view of the heat alarm of the present invention as mounted to an electric panel cabinet.

FIG. 1 shows a heat alarm 10 of the present invention as mounted to a conventional electric panel cabinet 12. The electric panel cabinet 12 typically encloses a variety of components used in running electric power through a building, such as circuit breakers, fuses, and busbars. Electric panel cabinet 12 is a generally box-like structure having a front face surface 14, a top face surface 16, a bottom face surface (not shown) and a pair of side face surfaces 18. In the embodiment of the invention shown in FIG. 1, the front face surface 14 of the electric panel cabinet 12 includes a latched door member 20 mounted for pivotal movement by a pair of hinges 22. The door member 20 can be selectively opened to provide access to the variety of components enclosed by the electric panel cabinet 12.

The heat alarm 10 generally includes a box-like enclosure 24 having a front face 26. As shown in FIG. 4, the enclosure 24 includes a removable battery cover 28 that provides access to a battery 30 mounted within an upper compartment defined by the interior of the enclosure 24.

Figure 2:
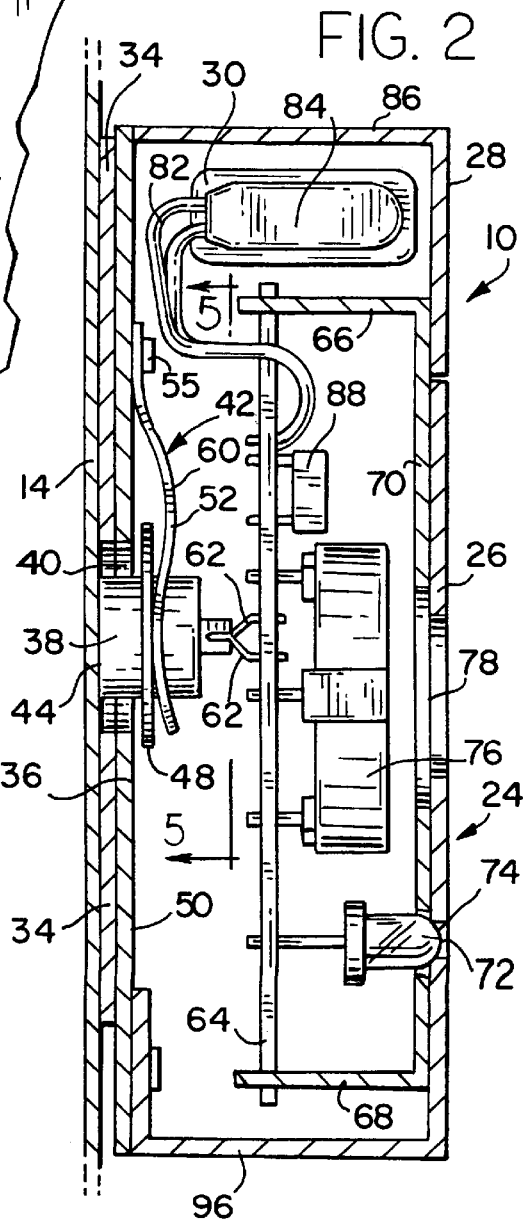
FIG. 2 is a sectional view taken along line 2—2 of FIG. 1 showing the internal components of the heat alarm of the present invention.
Figure 3:
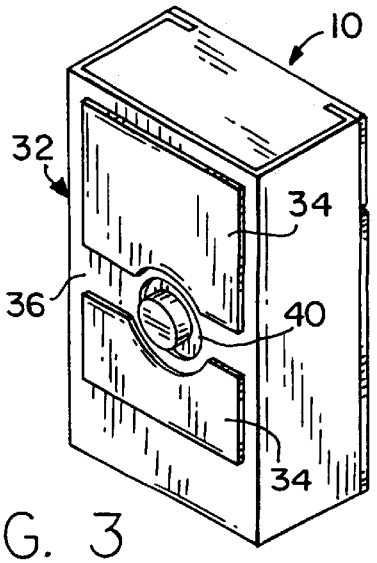
FIG. 3 is an isometric view of the heat alarm of the present invention showing the magnetic mounting arrangement.

Referring now to FIGS. 2 and 3, the heat alarm 10 includes a mounting arrangement 32 for attaching the heat alarm 10 to the electric panel cabinet 12. In the preferred embodiment of the invention, the mounting arrangement 32 includes a pair of magnetic members 34 affixed to a back, outer wall 36 of the enclosure 24. The magnetic members 34 can be fixed to the outer surface of the outer wall 36 in a conventional manner, such as commercially available adhesives. Although the magnetic members 34 of FIG. 3 are shown as being sheets of magnetic material, alternate configurations for the magnetic members 34 are contemplated, such as magnetic strips extending vertically or horizontally along the outer surface of the outer wall 36. Since the electric panel cabinet 12 is typically formed from a metallic material, such as steel, the magnetic members 34 that form the mounting arrangement 32 allow the heat alarm 10 to be magnetically attached to the electric panel cabinet 12 along any of the face surfaces of the electric panel cabinet 12. In the embodiment shown in FIG. 1, the heat alarm 10 is shown mounted adjacent to the door member 20 contained on the front face surface 14. However, the heat alarm 10 could also be mounted at other locations on the front face surface 14, including on the door member 20, to either of the side face surfaces 18, or to the top face surface 16 or the bottom face surface. Regardless of the location of heat alarm 10, the magnetic members 34 are of sufficient strength to hold the heat alarm 10 in place on the selected face surface of the electric panel cabinet 12 against the force of gravity.

As can best be seen in FIG. 2, a bimetallic, single pole, closed on temperature rise heat sensor 38 passes through a sensor opening 40 formed in the outer wall 36 of the enclosure 24. The heat sensor 38 is biased outward by a sensor mounting arrangement 42 such that a face 44 of the sensor 38 is pressed into contact with one of the face surfaces of the electric panel cabinet 12, such as the front face surface 14 shown in FIGS. 1 and 2.

In the preferred embodiment of the invention, the heat sensor 38 includes a bi-metal switch that closes when the surface temperature of the electric panel cabinet 12 reaches a predetermined value. Representatively, the heat sensor 38 may be selected such that the bi-metal switch closes when the surface temperature of the electric panel cabinet 12 reaches approximately 135° F., although it is understood that any other threshold temperature may be specified. The temperature sensor 38 may be such as is commercially available Model 36T, manufactured by Therm-O-Disc, Inc., a subsidiary of Emerson Electric Company, Mansfield, Ohio.

Since the electric panel cabinet 12 is formed from a metallic material having a relatively high thermal conductivity, the heat sensor 38 positioned against one of the face surfaces of the electric panel cabinet 12 can non-invasively monitor the temperature within the open interior defined by the enclosure 24 without actually extending into the open interior. That is, heat generated at any location within electric panel cabinet 12 is conducted throughout the walls of cabinet 12, such that heat alarm 10 is effectual regardless of the location at which it is mounted to cabinet 12. Although the surface temperature of the electric panel cabinet 12 may be slightly lower than the temperature within the open interior, the high thermal conductivity of the electric panel cabinet 12 will transfer any elevation in temperature within the open interior to the heat sensor 38. Unlike prior heat alarms, such as shown in the Altavela U.S. Pat. No. 5,416,367, the mounting arrangement 32 allows the heat alarm 10 to be moved around the face surfaces of the electric panel cabinet 12 without requiring a knockout opening or other type of access to the open interior defined by the electric panel cabinet 12, and temperature elevation can be detected without reliance on heat conduction by static air in the interior of cabinet 12.

As can best be seen in FIGS. 5 and 6, the sensor mounting arrangement 42 includes a spring member 46 having a free end to which sensor 38 is mounted, and which exerts an outward bias force on the heat sensor 38 to force the heat sensor 38 outward through the sensor opening 40 formed in the back, outer wall 36 of the enclosure 24. A stop member, such as a flange 48, is attached to the outer surface of the heat sensor 38. The flange 48 is sized slightly larger than the sensor opening 40, such that the flange 48 contacts the inner surface 50 of the back, outer wall 36 to limit the outward movement of the heat sensor 38. Thus, the interaction between the flange 48 and the inner surface 50 limits the movement of the heat sensor 30 to define an extended position for the heat sensor 38, as is shown in FIG. 6.

In the extended position, the face 44 of the heat sensor 38 extends further from the back, outer wall 36 of the enclosure 24 than the thickness of the magnetic members 34, as can be seen in FIG. 6. Thus, when the heat alarm 10 is mounted to the electric panel cabinet 12, the magnetic attraction between the magnetic members 34 and the face surface of the electric panel cabinet 12 forces the heat sensor 38 inward against the bias force exerted by the spring member 46, as shown in FIG. 2. When the heat sensor 38 is forced inward from the extended position, the flange 48 is spaced from the inner surface 50 of the back, outer wall 36. This inward movement is also shown in phantom in FIG. 6.

When the heat alarm 10 is mounted to the electric panel cabinet 12 and the heat sensor 38 is forced inward against the bias force exerted by the spring member 46, the bias force then holds the face 44 of the heat sensor 38 in contact with one of the face surfaces of the electric panel cabinet 12, such as the front face surface 14 in FIG. 2. Thus, the heat sensor 38 is held in direct contact with the face surface of the electric panel cabinet 12 and can accurately detect the surface temperature of the electric panel cabinet 12.

In the preferred embodiment of the invention, the spring member 46 is a spring arm 52 having a first end 54 secured to the back, outer wall 36 of the enclosure 24. As shown in FIG. 5, a pair of rivets 55 secures the first end 54 to the outer wall 36, although other types of connectors could be used. A second end 56 of the spring arm 52 contacts the flange 48 surrounding the heat sensor 38. A cut-out opening 58 in the second end 56 of the spring arm 52 allows the heat sensor 38 to pass through the spring arm 52. The spring arm 52 includes a curved, center portion 60 that is bent such that when the first end 54 is secured to the outer wall 36, the second end 56 exerts the bias force on the flange 48 to force the heat sensor 38 outward into its extended position, as shown in FIG. 6. In the preferred embodiment of the invention, the spring arm 52 is a metallic member having sufficient resiliency to allow the second end 56 to flex inward and outward to permit movement of the heat sensor 38 in the manner previously discussed.

When the heat alarm 10 is mounted to the electric panel cabinet 12, as shown in FIG. 2, the heat sensor 38 is forced inward such that the center portion 60 of the spring arm 52 is straightened. The bend formed in the center portion 60 exerts the bias force to force the heat sensor 38 outward into contact with the electric panel cabinet 12. Although the spring member 46 has been discussed and shown in the figures as being the spring arm 52, other types of spring elements are contemplated as being within the scope of the invention. For example, it is contemplated that the spring member 46 could be a coil spring positioned around the heat sensor 38 to exert the outward bias force on the heat sensor 38.

As can be seen in FIG. 2, the heat sensor 38 is connected by a pair of wires 62 to a circuit board 64. A pair of support tabs 66 and 68 included on a support bracket 70 securely retains the circuit board 64 within the enclosure 24. The support bracket 70 is securely mounted to the front face 26 of the enclosure 24 such that the support bracket 70 provides a secure point of attachment for the circuit board 64 and the components mounted thereto.

As can be seen in FIG. 2, various components are mounted to the circuit board 64 within the enclosure 24. Specifically, a visual indicator 72 is connected to the circuit board 64. The visual indicator 72 is aligned with an opening 74 in the front face 26 of the enclosure 24 such that the visible indicator 72 is visible from the exterior of the enclosure 24. In the preferred embodiment of the invention, the visual indicator 72 is a red LED.

An audible alarm 76 is also connected to the circuit board 64. The audible alarm 76 is aligned with a sound opening 78 extending through both the front face 26 and the support bracket 70. The sound opening 78 allows sound generated by the audible alarm 76 to freely pass through the enclosure 24 such that the sound can be clearly heard.

Although not shown in FIG. 2, a test/reset button 80 (FIG. 4) is connected to the circuit board 64. The test/reset button 80 is accessible through the front face 26 of the enclosure 24, as shown in FIG. 4. In the preferred embodiment of the invention, the test/reset button 80 is a conventional spring-loaded push-button switch that allows the user to manually test the operation of the audible alarm 76. As can best be seen in FIG. 2, a pair of leads 82 and a conventional battery harness 84 connects the battery 30 to the circuit board 64. The battery 30 is operatively connected via the circuit board 64 to provide the required power to operate the audible alarm 76 and the visual indicator 72. The battery 30 is contained within a battery chamber 86 defined by the support tab 66 and the battery cover 28. In this manner, the battery 30 can be replaced by simply removing the battery cover 28 and detaching the battery 30 from the battery harness 84 in a convention manner as shown in FIG. 4.

In the preferred embodiment of the invention, a microprocessor 88 is connected to the circuit board 64, as is shown in FIG. 2. The microprocessor 88 is coupled to the battery 30, the heat sensor 38, the visual indicator 72, the audible alarm 76, and the test/reset button 80 through the preprinted circuit board 64. In this manner, the microprocessor 88 can control the operation of the entire heat alarm 10 in a manner as described in commonly assigned, co-pending patent application Ser. No. 08/959,475, filed Oct. 28, 1997, the disclosure of which is hereby incorporated by reference. In the preferred embodiment of the invention, the microprocessor 88 is model no. PIC16C54 as sold by Motorola®. The microprocessor 88 is specifically selected based on its low power consumption in an attempt to extend the life of the battery 30, although it is understood that other microprocessors could be substituted while operating within the scope of the invention. Additionally, the heat alarm 10 could be constructed without the microprocessor 88 while still operating within the scope of the invention. In a heat alarm 10 without a microprocessor, the closure of the switch in the heat sensor 38 completes a connection between the battery 30 and the audible alarm 76 to activate the audible alarm 76.

A second embodiment for the mounting arrangement previously discussed is shown in FIGS. 7 and 8. In this embodiment, a pair of upper ears 90 and a pair of lower ears 91 are secured to the back, outer wall 36 of the enclosure 24. Each of the ears 90, 91 includes an opening 92 sized to receive a connector 94. The connector 94 can be inserted through the opening 92 and fixed to one of the face surfaces of the electric panel cabinet 12, such as the front face surface 14 shown in FIG. 8. In the preferred embodiment of the invention, the connector 94 is a screw that is received in a threaded opening formed in the front face surface 14.

In a heat alarm 10 incorporating the second embodiment of the mounting arrangement, the sensor mounting arrangement 42 is constructed such that the face 44 of the heat sensor 38 extends further from the outer wall 36 than the thickness of the ears 90,91 such that when the heat alarm 10 is attached to the electric panel cabinet 32, the heat sensor 38 is pressed inward from its extended position against the bias force exerted by the sensor mounting arrangement 42. In this manner, the sensor mounting arrangement 42, specifically spring arm 52, exerts a bias force to press the heat sensor 38 into contact with the electric panel cabinet in the same manner as previously discussed.

In yet another alternate embodiment of the invention, the mounting arrangement 32 could include a pressure-sensitive adhesive contained on the back, outer wall 36 of the enclosure 24. The pressure-sensitive adhesive must be sufficiently strong to hold the enclosure 24 in contact with the front face surface 14 against the bias force exerted by the sensor mounting arrangement 42 and against the force of gravity.

Although the present invention has been described as including the mounting arrangement 32 along the back, outer wall 36 of the enclosure 24, it is also contemplated by the inventor that the mounting arrangement 32 could be positioned along any outer wall of the enclosure 24. For example, the mounting arrangement 32 could be positioned along the bottom wall 96 (FIG. 2) of the enclosure 24 and the heat sensor 38 moved to extend through a similar sensor opening that would then be formed in the bottom wall 96.

Although the present invention has been described as being mounted to an electric panel cabinet 12 for detecting an overheat condition within the cabinet, it is contemplated by the inventor that the heat alarm 10 could also be mounted to other types of metallic housings of which the temperature is important. For example, it is contemplated that the heat alarm 10 could be magnetically attached to a clothes dryer, electric motor or similar metallic housing including components that may overheat.

Various alternatives and embodiments are contemplated as being within the scope of the following claims particularly pointing out and distinctly claiming the subject matter regarded as the invention.

I claim:

1. In a heat alarm for an electrical panel cabinet, the heat alarm including an enclosure, a power supply contained within the enclosure, a heat sensor to detect a temperature rise, and an alarm device that is activated in response to the heat sensor, the improvement comprising:

an enclosure mounting arrangement interconnected with an outer wall of the enclosure for attaching the enclosure to a face surface of the electric panel cabinet; and a sensor mounting arrangement for contacting the heat sensor with the face surface of the electric panel cabinet when the enclosure is attached to the face surface of the electric panel cabinet.

2. The improvement of claim 1 wherein the outer wall of the enclosure includes a sensor opening such that at least a portion of the heat sensor protrudes from the enclosure and into contact with the face surface of the electric panel cabinet through the sensor opening.

3. The improvement of claim 1 wherein the sensor mounting arrangement includes a spring member that exerts a bias force on the heat sensor to force the heat sensor into contact with the face surface of the electric panel cabinet.

4. The improvement of claim 3 wherein the spring member is a spring arm having a first end fixed to the enclosure and a second end in contact with the heat sensor.

5. The improvement of claim 4 wherein the heat sensor includes a flange that contacts an outer edge of the sensor opening formed in the outer wall of the enclosure to limit the outward movement of the heat sensor in the sensor opening.

6. The improvement of claim 1 wherein the enclosure mounting arrangement includes at least one magnetic member secured to the outer wall of the enclosure to provide magnetic attachment of the enclosure to the electric panel cabinet.

7. The improvement of claim 6 wherein the sensor mounting arrangement includes a spring member that exerts a bias force on the heat sensor to force the heat sensor outward through a sensor opening formed in the outer wall of the enclosure and into contact with the face surface of the electric panel cabinet.

8. The improvement of claim 7 wherein the spring member is arranged such that the bias force urges the heat sensor into an extended position in which the heat sensor extends from the outer wall of the enclosure a distance greater than the thickness of the magnetic member, such that when the enclosure is mounted to the electric panel cabinet, the heat sensor is forced inward from its extended position against the bias force and is held in contact with the face surface of the electric panel cabinet by the bias force.

9. The improvement of claim 8 wherein the heat sensor includes a flange that contacts an outer edge of the sensor opening formed in the outer wall of the enclosure to limit the outward movement of the heat sensor caused by the bias force to define the extended position for the sensor.

10. A heat alarm for detecting the temperature of a metallic housing, the heat alarm comprising:

an enclosure defining an interior and having a sensor opening formed therein;

a magnetic mounting arrangement attached to the enclosure for magnetically attaching the enclosure to a face surface of the metallic housing;

a heat sensor positioned to extend through the sensor opening and into contact with the face surface of the metallic housing when the enclosure is attached to the metallic housing, the heat sensor being positioned to detect the temperature of the metallic housing;

a sensor mounting arrangement interconnected with the enclosure and including a spring member for exerting a bias force on the heat sensor to bias the heat sensor into contact with the face surface of the metallic housing when the enclosure is attached to the face surface of the metallic housing; and an alarm device coupled to the heat sensor, the alarm device being activated when the temperature of the metallic housing exceeds an upper temperature limit.

11. The heat alarm of claim 10 wherein the sensor includes a stop member that limits the movement of the heat sensor within the sensor opening caused by the bias force, the stop member acting to define an extended position for the sensor when the enclosure is detached from the metallic housing.

12. The heat alarm of claim 11 wherein the thickness of the magnetic mounting arrangement is less than the distance the heat sensor extends from the enclosure in the extended position, such that when the enclosure is mounted to the metallic housing, the heat sensor is forced inward from its extended position against the bias force and is held in contact with the face surface of the metallic housing by the bias force.

13. The heat alarm of claim 10 wherein the spring member is a spring arm having a first end fixed to the enclosure and a second end positioned to exert the bias force on the sensor.

14. A method of mounting a heat alarm including a heat sensor to an electric panel cabinet, the method comprising the steps of:

interconnecting a contact-type sensor mounting arrangement with the heat alarm; and engaging the heat alarm with the electric panel cabinet to hold the heat alarm in place on the electric panel cabinet;

wherein engagement of the heat alarm with the electric panel cabinet results in the heat sensor being held in physical contact with the electric panel cabinet by the sensor mounting arrangement.

15. The method of claim 14 further comprising the step of attaching a stop member to the heat sensor, the stop member functioning to limit the outward movement of the heat sensor relative to the heat alarm.

16. The method of claim 14 wherein the sensor mounting arrangement includes a spring arm having a fixed-position first end and a second end spaced therefrom and positioned to exert the bias force on the sensor.

17. The method of claim 14 further comprising the step of moving the heat sensor inward against a bias force when the heat alarm is attached to the electric panel cabinet for maintaining the heat sensor in contact with the electric panel cabinet.

18. A heat alarm for an electrical panel cabinet, comprising:

a heat sensor;

a heat sensor mounting arrangement interconnected with the heat sensor and adapted for mounting to the electrical panel cabinet for contacting the heat sensor with a surface of the electrical panel cabinet; and an alarm interconnected with the heat sensor for providing an alarm output when the temperature of the electrical panel cabinet exceeds a predetermined limit.

19. The heat alarm of claim 18, further comprising an enclosure within which the alarm is received, and wherein the heat sensor mounting arrangement is interconnected with the enclosure.

20. The heat alarm of claim 19, wherein the enclosure is engageable with the electrical panel cabinet and defines a wall adapted for placement adjacent a surface of the electrical panel cabinet, and wherein the heat sensor mounting arrangement is interconnected with the wall of the enclosure.

* * * * *